US010843094B1

(12) United States Patent
Balanchi

(10) Patent No.: US 10,843,094 B1
(45) Date of Patent: Nov. 24, 2020

(54) STACKABLE RADIO-CONTROLLED TOY

(71) Applicant: Mindscope Products Inc., Glendale, CA (US)

(72) Inventor: George Balanchi, Glendale, CA (US)

( * ) Notice: Subject to any disclaimer, the term of this patent is extended or adjusted under 35 U.S.C. 154(b) by 0 days.

(21) Appl. No.: 16/564,356

(22) Filed: Sep. 9, 2019

(51) Int. Cl.
*A63H 17/00* (2006.01)
*A63H 29/22* (2006.01)
*A63H 17/26* (2006.01)
*A63H 30/04* (2006.01)

(52) U.S. Cl.
CPC ..... *A63H 17/264* (2013.01); *A63H 30/04* (2013.01); *A63H 29/22* (2013.01)

(58) Field of Classification Search
CPC ..... A63H 17/264; A63H 29/22; A63H 30/04; A63H 33/086
USPC ..... 446/465, 470, 124
See application file for complete search history.

(56) References Cited

U.S. PATENT DOCUMENTS 2,357,179 A * 8/1944 Ebeling ..... A63H 17/002 446/449
2,577,102 A * 12/1951 Bolger ..... A63H 33/007 446/449
3,496,670 A * 2/1970 Ryan ..... A63H 33/088 446/104
3,670,449 A * 6/1972 Lemkin ..... A63H 33/088 446/102
4,446,649 A * 5/1984 Moe ..... A63H 33/04 446/128
4,940,442 A * 7/1990 Matsuda ..... A63H 17/264 213/75 TC
5,813,894 A * 9/1998 Tohyama ..... A63H 17/262 446/448
6,679,750 B1 * 1/2004 Nielsen ..... A63H 7/00 446/278
6,786,795 B1 * 9/2004 Mullaney ..... A63H 17/05 446/431
7,789,728 B2 * 9/2010 Friedman ..... A63H 17/264 446/429
8,939,812 B2 * 1/2015 Chan ..... A63H 30/02 446/456
9,415,319 B1 * 8/2016 Jarrett ..... A63H 18/02
9,931,580 B2 * 4/2018 Rehkemper ..... A63H 17/008
2004/0023593 A1 * 2/2004 Needham ..... A63H 17/12 446/129
2012/0015583 A1 * 1/2012 Chen ..... A63H 33/086 446/124
2013/0078888 A1 * 3/2013 Mayer ..... A63H 11/00 446/433

(Continued)

*Primary Examiner* — Alexander R Niconovich
(74) *Attorney, Agent, or Firm* — Landmark Intellectual Property Law, PC; Gregory M Murphy

(57) ABSTRACT

A radio-controlled (RC) toy includes a pair of RC toy vehicles having toy bodies with generally planar base portions. Each toy vehicle has a plurality of wheels rotatably mounted thereon. A coupling arrangement stacks the toy vehicles along a stacking axis that is generally perpendicular to the base portions, and connects the toy vehicles together in a stacked vehicle configuration in which the base portions face each other. At least one RC controller controls movement of at least one of the toy vehicles for individual vehicle movement in a single vehicle configuration over a support surface, and for joint movement of the toy vehicles in the stacked vehicle configuration over the support surface.

16 Claims, 7 Drawing Sheets

(56) References Cited

U.S. PATENT DOCUMENTS

| | | | | |
|---|---|---|---|---|
| 2015/0258463 | A1* | 9/2015 | Park | A63H 33/102<br>446/124 |
| 2018/0147501 | A1* | 5/2018 | Sorensen | A63H 17/262 |

* cited by examiner

STACKABLE RADIO-CONTROLLED TOY

BACKGROUND

This invention relates to radio-controlled toy vehicles and, more particularly, to moving each toy vehicle individually in a single vehicle configuration, or jointly moving the toy vehicles together in a stacked vehicle configuration.

Many radio-controlled or remote-controlled (RC) toys, such as toy vehicles, e.g., cars, boats and planes, are known in the art and are popular with children and other enthusiasts, because they allow the user to directly control and effect the action and movement of the toys. Such toys are typically controlled by the use of a dedicated, handheld, wireless controller having manually operated controls, e.g., movable joysticks, and a radio frequency (RF) transmitter that broadcasts RF signals corresponding to user movement of the joysticks, to an RF receiver in the toy. Battery-driven electrical motors and servos typically provide propulsion to move and steer the toy, as well as to carry out other commands dictated by user movement of the joysticks.

One drawback of the known RC toy vehicles is that the design or configuration of the toy vehicle is fixed and does not change. For example, a toy vehicle having four wheels on the ground remains a toy vehicle having its four wheels on the ground during its forward or backward, and/or rightward or leftward, movement. This heightens the possibility that a user, particularly a child, will eventually lose interest in playing with the toy vehicle.

Accordingly, it is desirable to provide an RC toy that extends a child's playtime activity, and to transform the toy from one configuration to another in order to enhance the playtime activity, it is further desirable to provide such a toy that is simple in construction, inexpensive to manufacture, compact, ornamental in appearance, and durable and safe in use.

BRIEF DESCRIPTION OF THE FIGURES

The accompanying figures, where like reference numerals refer to identical or functionally similar components throughout the separate views, together with the detailed description below, are incorporated in and form part of the specification, and serve to further illustrate embodiments of concepts that include the claimed invention, and explain various principles and advantages of those embodiments.

DETAILED DESCRIPTION

Figure 1:
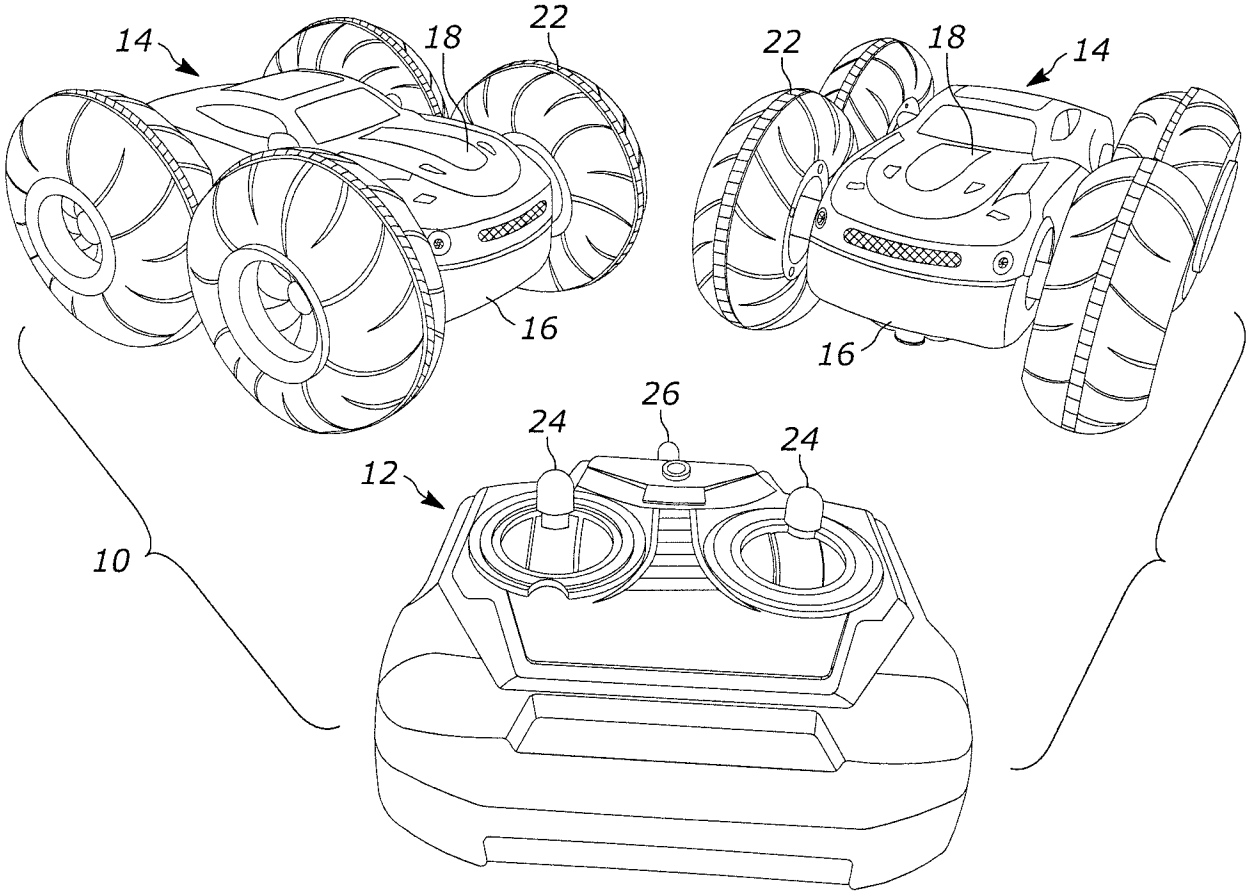
FIG. 1 is an overhead perspective view of an RC toy with at least one controller and a pair of toy vehicles, each in a single vehicle configuration, in accordance with this disclosure.

Referring now to the drawings, reference numeral 10 identifies an RC toy having at least one handheld, wireless, RF controller 12, and a pair of identical toy vehicles 14 convertible or transformable, as described below, between a first single vehicle configuration (see FIG. 1) in which the individual to vehicles 14 are each capable of individual single vehicle movement by operation of the controller 12, and a second stacked vehicle configuration (see FIG. 2) in which the toy vehicles 14, 14 are stacked, one on top of the other, and are capable of joint movement by operation of the controller 12.

Each toy vehicle 14 has a toy body 16 with a top portion 18, a generally planar base portion 20, and a plurality of wheels 22, preferably four in number, rotatably mounted thereon. The toy body 16 is elongated and extends between a front end and a rear end. The top portion 18 is situated opposite to, and spaced away from, its corresponding base portion 20 by a height dimension. As illustrated, each toy vehicle 14 resembles a racing car whose wheels 22 are oversized, with each wheel 22 having a diameter greater than said height dimension.

It will be understood that this invention is not intended to be limited to the illustrated racing car, because many other types of toy vehicles are contemplated by this disclosure. For example, rather than a simulated racing car, other toy cars, such as an automobile, a taxi, or a police car (non-illustrated graphics and/or text may be applied over the toy body 16 to complete the simulation), the toy vehicle could be configured as a construction machine, such as a bulldozer, a forklift truck, a front loader, etc. The toy could also be configured as other types of vehicles, such as a train car, an airplane, a truck, a bus, a wagon, etc.

Figure 2:
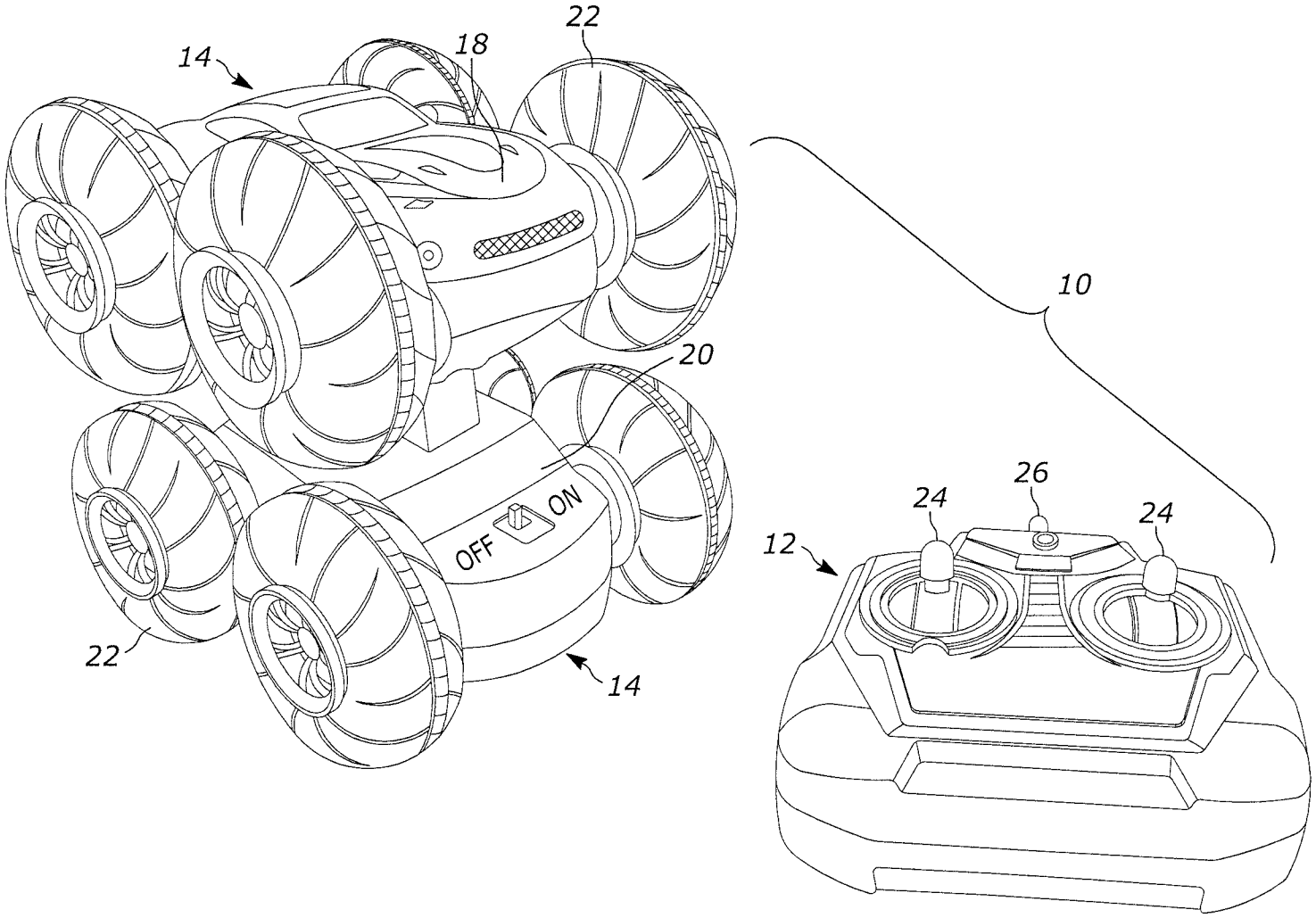
FIG. 2 is an overhead perspective view of the toy of FIG. 1 after the toy vehicles have been stacked in a different, stacked vehicle configuration in accordance with this disclosure.

As shown in the single vehicle configuration of FIG. 1, the controller 12 is operative for controlling movement of either one, or simultaneously both, of the toy vehicles 14 for individual vehicle movement over a support surface, such as the ground. The controller 12 has manual controls, movable joysticks 24, to move (forward and back) and steer (right or left) the toy vehicles 14, as well as to carry out other commands dictated by user movement of the joysticks 24. The controller 12 also has an RF antenna 26 and an internal RF transmitter (not illustrated) that broadcasts RF signals corresponding to user movement of the joysticks 24, to an RF' receiver in each toy vehicle 14 to operate battery-driven electrical motors and servos therein.

In accordance with this disclosure, a coupling arrangement is configured to stack the toy vehicles 14 along a vertical stacking axis that is generally perpendicular to the generally planar base portions 20 that lie along horizontal planes. The coupling arrangement connects the toy vehicles 14 together, one on top of the other, in the stacked vehicle configuration in which the base portions 20 face each other in a close, confronting, adjacent relationship and in mutual parallelism with each other.

Figure 6:
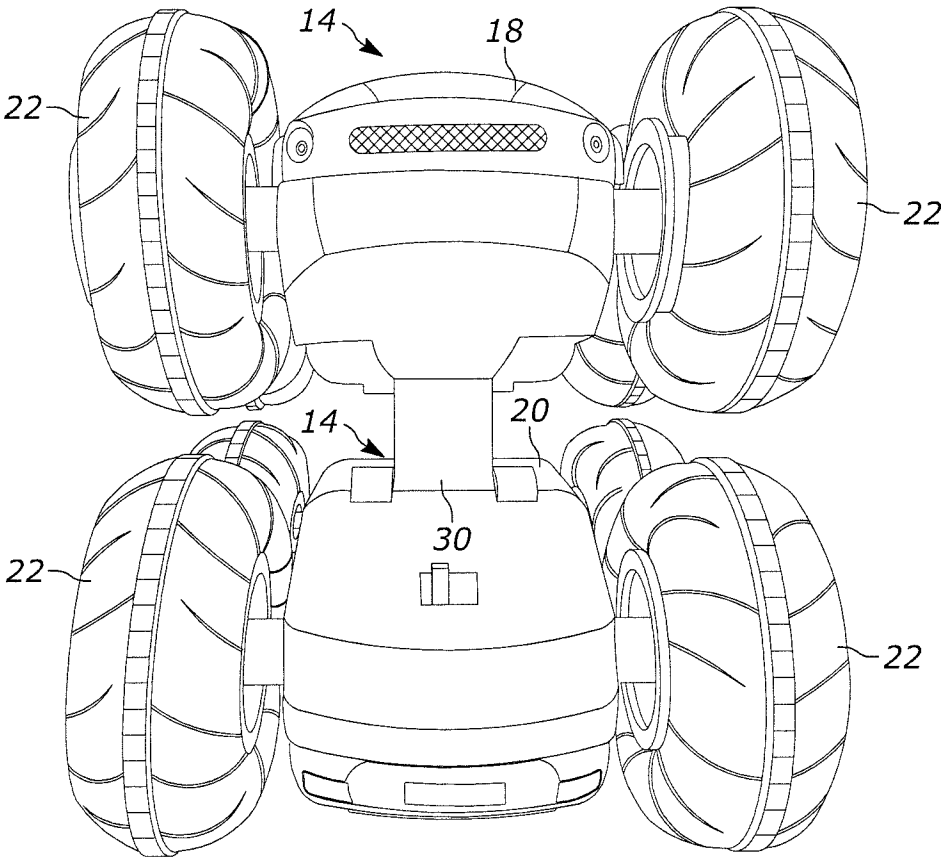
FIG. 6 is an end elevation view of the toy vehicles in the stacked vehicle configuration of FIG. 2.
Figure 7:
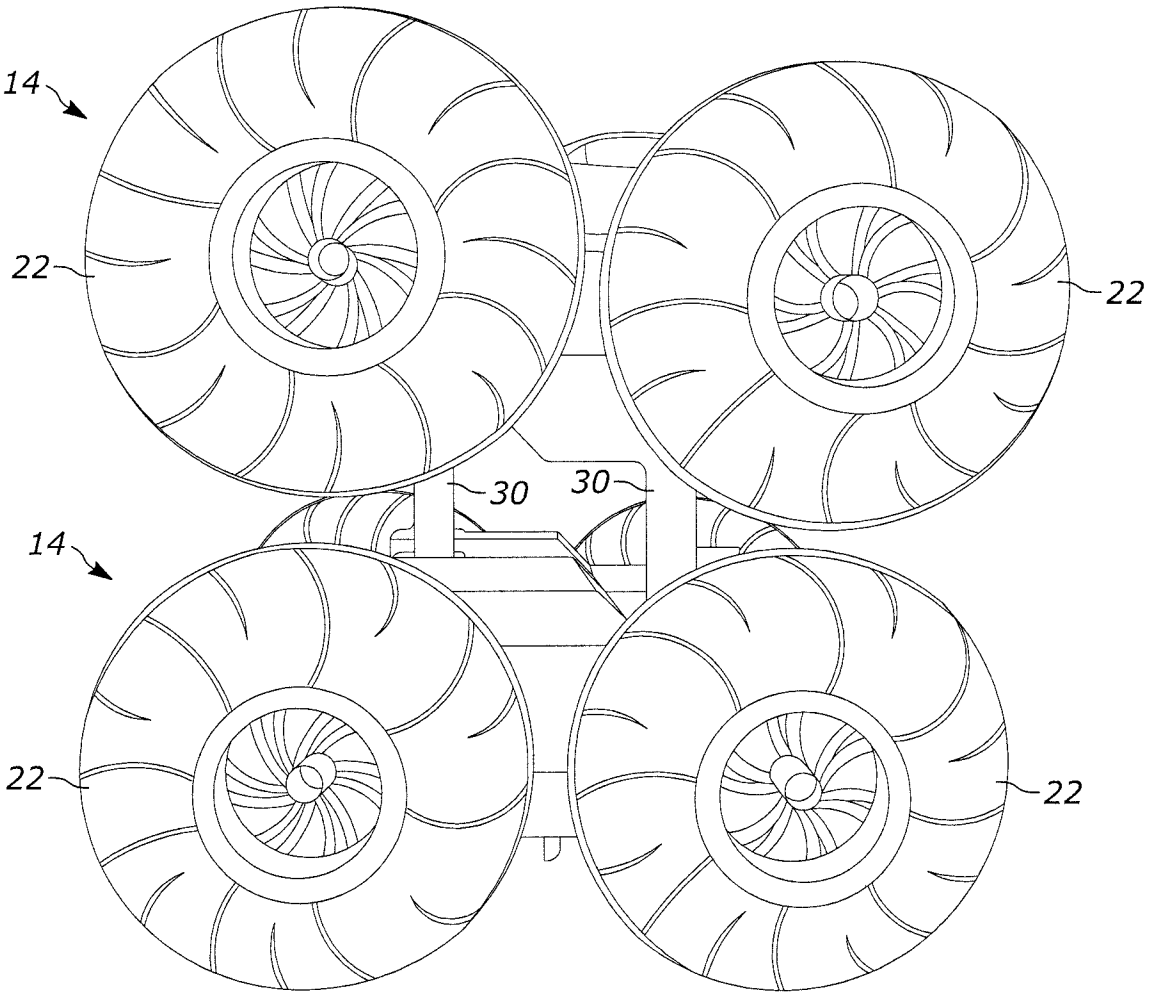
FIG. 7 is a side elevation view of the toy of FIG. 6.

As best shown in FIGS. 6-7, the coupling arrangement holds the toy vehicles 14 apart in the stacked vehicle configuration at a vertical spacing along the vertical stacking axis in which the wheels 22 of one of the toy vehicles 14 are held out of contact with the wheels 22 of the other of the toy vehicles 14. Also, the wheels 22 of one of the toy vehicles 14 overlie the wheels 22 of the other of the toy vehicles 14 in the stacked vehicle configuration. In addition, the front end of one of the toy vehicles 14 overlies the rear end of the other of the toy vehicles 14 in the stacked vehicle configuration such that the toy vehicles 14 are reversely oriented.

Figure 3:
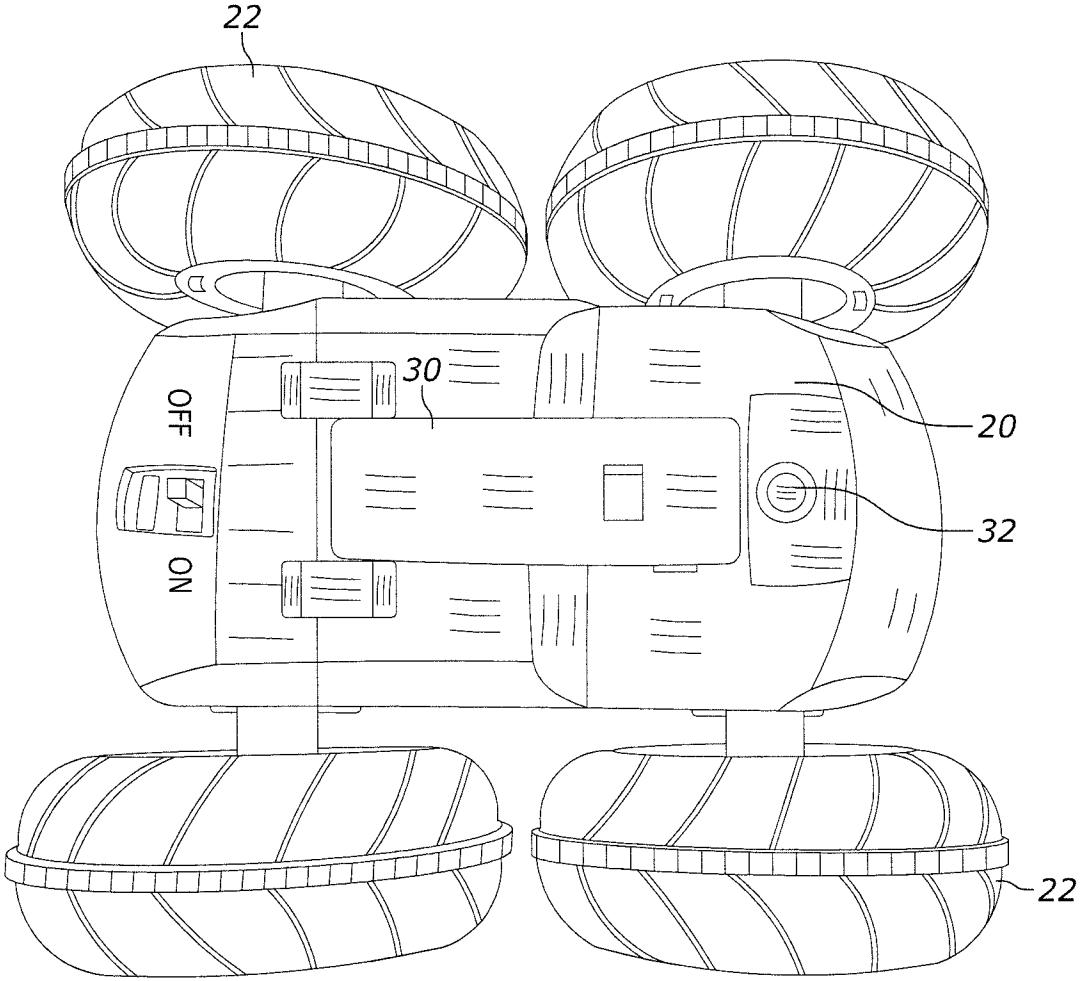
FIG. 3 is an enlarged bottom perspective view of a representative one of the toy vehicles of FIG. 1, and depicting a coupling member in a stored position.
Figure 4:
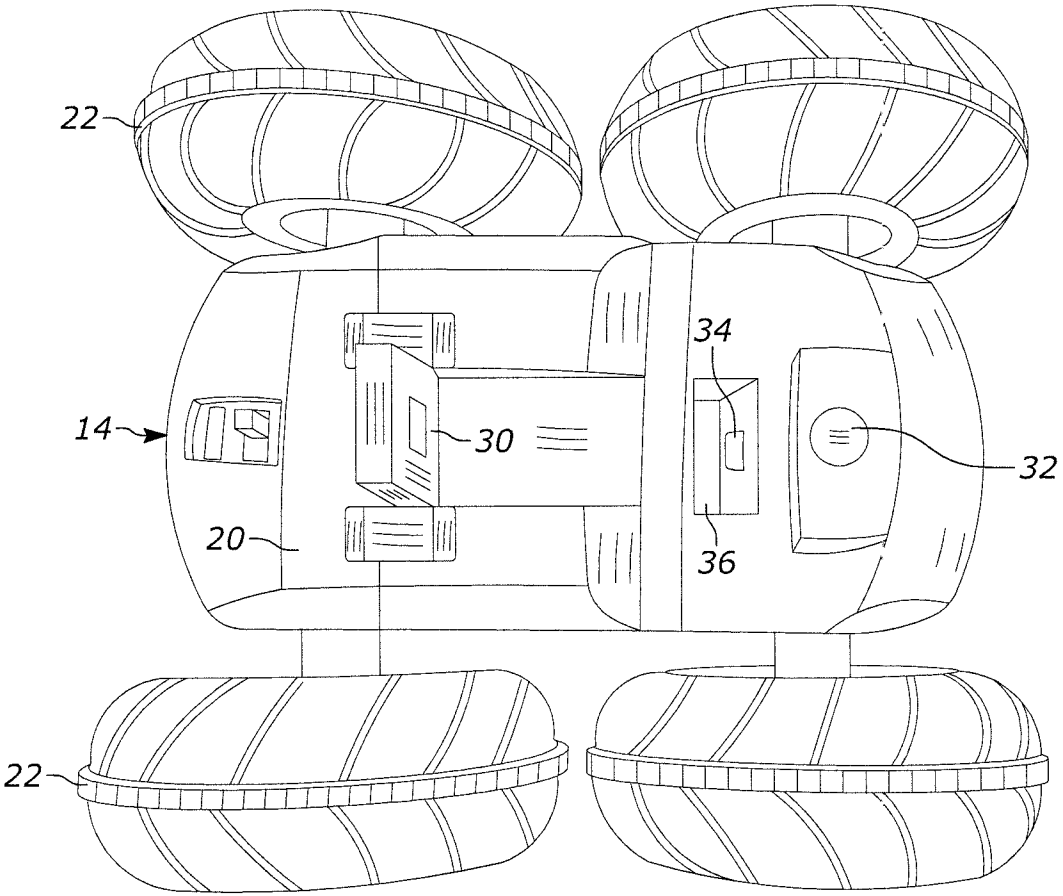
FIG. 4 is a view analogous to FIG. 3, but with the coupling member in a coupled position.
Figure 5:
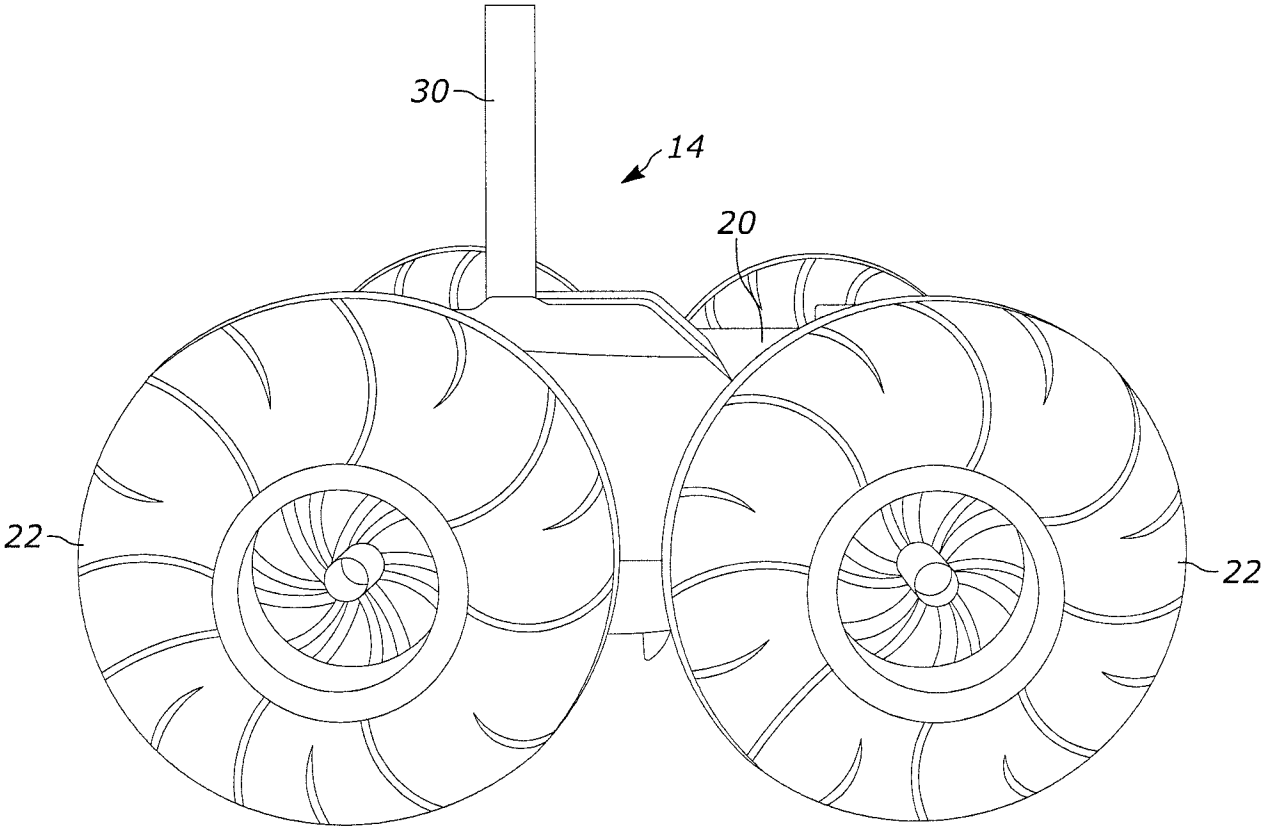
FIG. 5 is a side elevation view of the toy of FIG. 4.

As shown in FIGS. 3-5, the coupling arrangement includes a coupling member 30 mounted on each base portion 20 for movement between a stored position (see FIG. 3) in which the coupling member 30 is generally co-planar with its corresponding base portion 20, and a coupled position (see FIGS. 4-5) in which the coupling member 30 is generally perpendicular to its corresponding base portion 20. Each coupling member 30 is preferably a solid, bar-shaped arm or projection that is pivotably mounted on its corresponding base portion 20.

An actuatable lock is provided on each base portion 20 for locking each coupling member 30 in the stored position, and for releasing each coupling member 30 from the stored position when the lock is actuated. Advantageously, each lock includes a manually actuatable push button 32, and a resilient latch 34 for latching the corresponding coupling member 30 in the stored position, and for unlatching the corresponding coupling member 30 when the push button 32 is manually actuated, e.g., pushed.

The coupling arrangement further includes a coupling recess 36 on each base portion 20. The coupling recess 36 on one of the toy vehicles 14 is configured to receive the coupling member 30 of the other of the toy vehicles 14 in the stacked vehicle configuration. Preferably, each coupling member 30 overlies and covers its corresponding coupling recess 36 in the stored position, and exposes its corresponding coupling recess 36 in the coupled position.

As best seen in FIG. 7, the coupling members 30 in the coupled position are elongated and extend in generally mutual parallelism along the vertical stacking axis in the stacked vehicle configuration, The coupling members 30 are preferably received in the coupling recesses 36 with a press fit, although other connections may be utilized.

In operation, the RC controller 12 is operative to control joint movement of the toy vehicles 14 in the stacked vehicle configuration over the support surface. In addition to forward or backward, and/or leftward or rightward, movement, the stacked vehicles 14 can flip over so that the vehicle 14 on the top of the stack is now situated at the bottom of the stack, Thus, a four-wheeled toy has been converted into an eight-wheeled toy, thereby enhancing the child's playtime activity.

In one variation, a single set consisting of one toy vehicle 14 and one remote controller 12 may be sold in one retail package, in which case, a user may purchase two sets, e.g., for two children, and then both sets can be operated independently. When the user wants to combine the sets together, the user can take both toy vehicles 14 and stack them together with the built-in coupling arrangement, in which case, either remote controller 22 will be able to operate the eight-wheel combined vehicle toy. This is of special benefit when each controller has a radio frequency that is dedicated to a particular toy vehicle 14.

In another variation, two toy vehicles 14 and two remote controllers 12 may be sold in one retail package, in which case, each toy vehicle 14 can be operated separately with its own remote controller 22, and both toy vehicles 14 may be stacked, and then operated by either remote controller 22.

It will be understood that each of the components described above, or two or more together, also may find a useful application in other types of constructions differing from the types described above.

While the invention has been illustrated and described as embodied in a stackable RC toy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A radio-controlled ("RC") toy, the toy comprising:

two or more RC toy vehicles having individual toy bodies with individual generally planar base portions, each toy vehicle having a plurality of wheels rotatably mounted thereon;

a coupling arrangement for stacking the toy vehicles along a stacking axis that is generally perpendicular to the base portions, and for connecting the toy vehicles together in a stacked vehicle configuration in which the base portions face each other; and at least one RC controller, the RC controller capable of:

controlling movement of at least one of the toy vehicles for individual vehicle movement in a single vehicle configuration over a support surface, and controlling joint movement of the toy vehicles in the stacked vehicle configuration over the support surface, wherein during joint movement in the stacked configuration the RC controller broadcasts radio-frequency signals that are received by both RC toy vehicles.

2. The RC toy of claim 1, wherein each toy body has a top portion spaced away from its corresponding base portion by a height dimension, and wherein each wheel has a diameter greater than said height dimension.

3. The RC toy of claim 1 wherein the coupling arrangement holds the toy vehicles apart in the stacked vehicle configuration at a spacing along the stacking axis in which the wheels of one of the toy vehicles are held out of contact with the wheels of the other of the toy vehicle.

4. The RC toy of claim 1, wherein each toy vehicle in the single vehicle configuration has four wheels, and wherein two toy vehicles in the stacked vehicle configuration have eight wheels.

5. The RC toy of claim 1, wherein each toy vehicle has a front end and a rear end, and wherein the front end of one of the toy vehicles overlies the rear end of the other of the toy vehicles in the stacked vehicle configuration.

6. The RC toy of claim 1, wherein the wheels of one of the toy vehicles overlie the wheels of the other of the toy vehicles in the stacked vehicle configuration.

7. The RC toy of claim 1, wherein the coupling arrangement includes a coupling member mounted on each base portion for movement between a stored position in which the coupling member is generally co-planar with its corresponding base portion, and a coupled position m which the coupling member is generally perpendicular to its corresponding base portion.

8. The RC toy of claim 7, wherein each coupling member is a bar-shaped arm that is pivotably mounted on its corresponding base portion.

9. The RC toy of claim 7, and an actuatable lock on each base portion for locking each coupling member in the stored position, and for releasing each coupling member from the stored position when the lock is actuated.

10. The RC toy of claim 9, wherein each lock includes a manually actuatable push button, and a resilient latch for latching the corresponding coupling member in the stored position, and for unlatching the corresponding coupling member when the push button is manually actuated.

11. The RC toy of claim 7, wherein the coupling arrangement further includes a coupling recess on each base portion, and wherein the coupling recess on one of the toy vehicles is configured to receive the coupling member of the other of the toy vehicles in the stacked vehicle configuration.

12. The RC toy of claim 11, wherein each coupling member overlies and covers its corresponding coupling recess in the stored position, and exposes its corresponding coupling recess in the coupled position.

13. The RC toy of claim 11, wherein the coupling members in the coupled position are elongated and extend generally parallel to the stacking axis in the stacked vehicle configuration.

14. The RC toy of claim 1, further comprising an additional RC controller for controlling the other of the toy vehicles, and wherein each controller and each toy vehicle constitute a set.

15. The RC toy of claim 1, further comprising an additional RC controller for controlling the other of the toy vehicles, and wherein both controllers and both toy vehicles constitute a set.

16. The RC toy of claim 1, wherein when two toy vehicles are in the stacked vehicle configuration, the RC toy operates in an upside position using the RC controller, driven by the wheels of what was the top toy vehicle, now in contact with the support surface.

* * * * *